US007237973B1

(12) United States Patent
Lou

(10) Patent No.: US 7,237,973 B1
(45) Date of Patent: Jul. 3, 2007

(54) COSMETIC STRUCTURE

(75) Inventor: Kun Lan Lou, Changhua (TW)

(73) Assignee: Jia Hsing Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 11/492,814

(22) Filed: Jul. 26, 2006

(51) Int. Cl.
*B43K 5/16* (2006.01)
*A46B 17/04* (2006.01)
*A45D 40/26* (2006.01)

(52) U.S. Cl. ..... 401/116; 401/269; 132/218

(58) Field of Classification Search ..... 401/99, 401/116, 117, 270, 277, 269; 132/216, 218, 132/317
See application file for complete search history.

(56) References Cited

U.S. PATENT DOCUMENTS 2,623,231 A * 12/1952 Gutenstein ..... 401/116
3,309,728 A * 3/1967 Seaver ..... 15/184
6,418,939 B1 * 7/2002 Byun ..... 132/313
* cited by examiner

*Primary Examiner*—David J. Walczak
(74) *Attorney, Agent, or Firm*—Troxell Law Office, PLLC

(57) ABSTRACT

A cosmetic structure including a sleeve a middle section of which is formed with an annular stopper section defining a fitting hole. A cock is fitted in the fitting hole to divide an interior of the sleeve into a receiving space and an operation space, whereby a liquid cosmetic can be contained in the receiving space. A lower section of the sleeve is formed with two opposite guide slots communicating with the operation space. An operation rod is fitted through a binding hole of the cock. A brush stem is inserted in a top end of the operation rod. The top end of the operation rod protrudes from the cock into the receiving space. The receiving space has an opening in which a hollow plug with a leakproof ring is fitted. A cap body is engageable with the plug. A bottom end of operation rod has a guide seat attaching to an inner face of the wall of the operation space. Two opposite guide blocks are disposed on a circumference of the guide seat. The guide blocks extend through the guide slots. A controlling collar is rotatably fitted around the operation space. An inner circumference of the controlling collar is formed with a spiral groove in which the guide blocks of the guide seat are inlaid.

10 Claims, 6 Drawing Sheets

COSMETIC STRUCTURE

BACKGROUND OF THE INVENTION

The present invention is related to an improved cosmetic structure including a sleeve. An inner circumference of a middle section of the sleeve is formed with an annular stopper section defining a fitting hole. A cock is fitted in the fitting hole to divide the interior of the sleeve into a receiving space and an operation space. A liquid cosmetic is contained in the receiving space. An operation rod having guide blocks and brush hairs is fitted through the cock from the operation space to the receiving space. A controlling collar formed with a spiral groove in cooperation with the guide blocks of the operation rod is fitted around the operation space. By means of turning the controlling collar clockwise or counterclockwise, the operation rod can extend out from the sleeve for doing makeup or retract into the sleeve. The cosmetic of the present invention can be conveniently used with one hand.

FIG. 1 shows a conventional eyelash brush 10. The eyelash brush 10 has a bottle 11 for containing an eyelash grower and a cap 13. The cap 13 has a brush 121 and a stem 12. The brush 121 can be dipped into the eyelash grower and taken out to make up the eyelash. However, when taken out from the bottle 11, the brush hairs of the brush 121 will be stained with a great amount of eyelash grower. A user needs to carefully take out the brush 121 and scrape off the excessive eyelash grower from the brush 121 against the opening 111 of the bottle 11. Then the user can brush the eyelash grower on the eyelashes. Moreover, the user needs to hold the bottle 11 with one hand and pinches the cap 13 with the other hand to do the makeup. This is quite inconvenient.

SUMMARY OF THE INVENTION

It is therefore a primary object of the present invention to provide an improved cosmetic structure including a sleeve. An inner circumference of a middle section of the sleeve is formed with an annular stopper section defining a fitting hole. A cock is fitted in the fitting hole to divide the interior of the sleeve into a receiving space and an operation space. A liquid cosmetic is contained in the receiving space. An operation rod having guide blocks and brush hairs is fitted through the cock from the operation space to the receiving space. A controlling collar formed with a spiral groove in cooperation with the guide blocks of the operation rod is fitted around the operation space. By means of turning the controlling collar clockwise or counterclockwise, the operation rod can extend out from the sleeve for doing makeup or retract into the sleeve. The cosmetic of the present invention can be conveniently used with one hand.

The present invention can be best understood through the following description and accompanying drawings wherein:

DETAILED DESCRIPTION OF THE PREFERRED EMBODIMENTS

Figure 1:
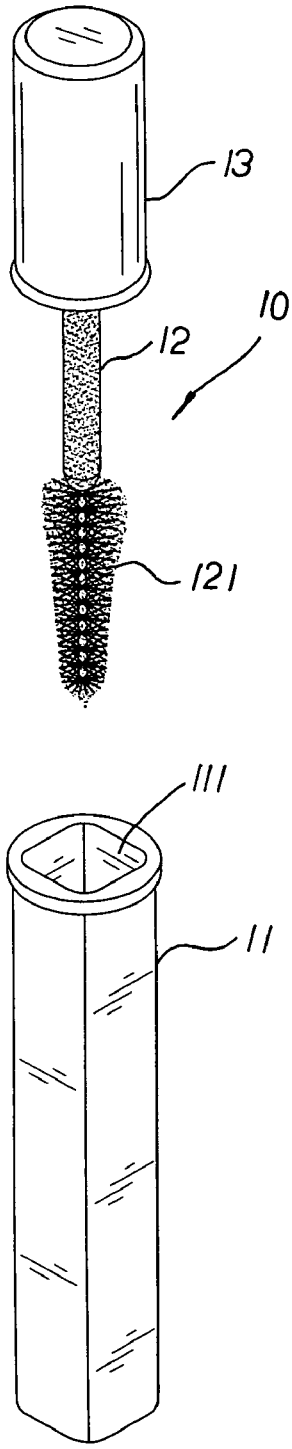
FIG. 1 PRIOR ART
FIG. 1 is a perspective view of a conventional eyelash brush, in which the cap is taken out from the bottle.
Figure 2:
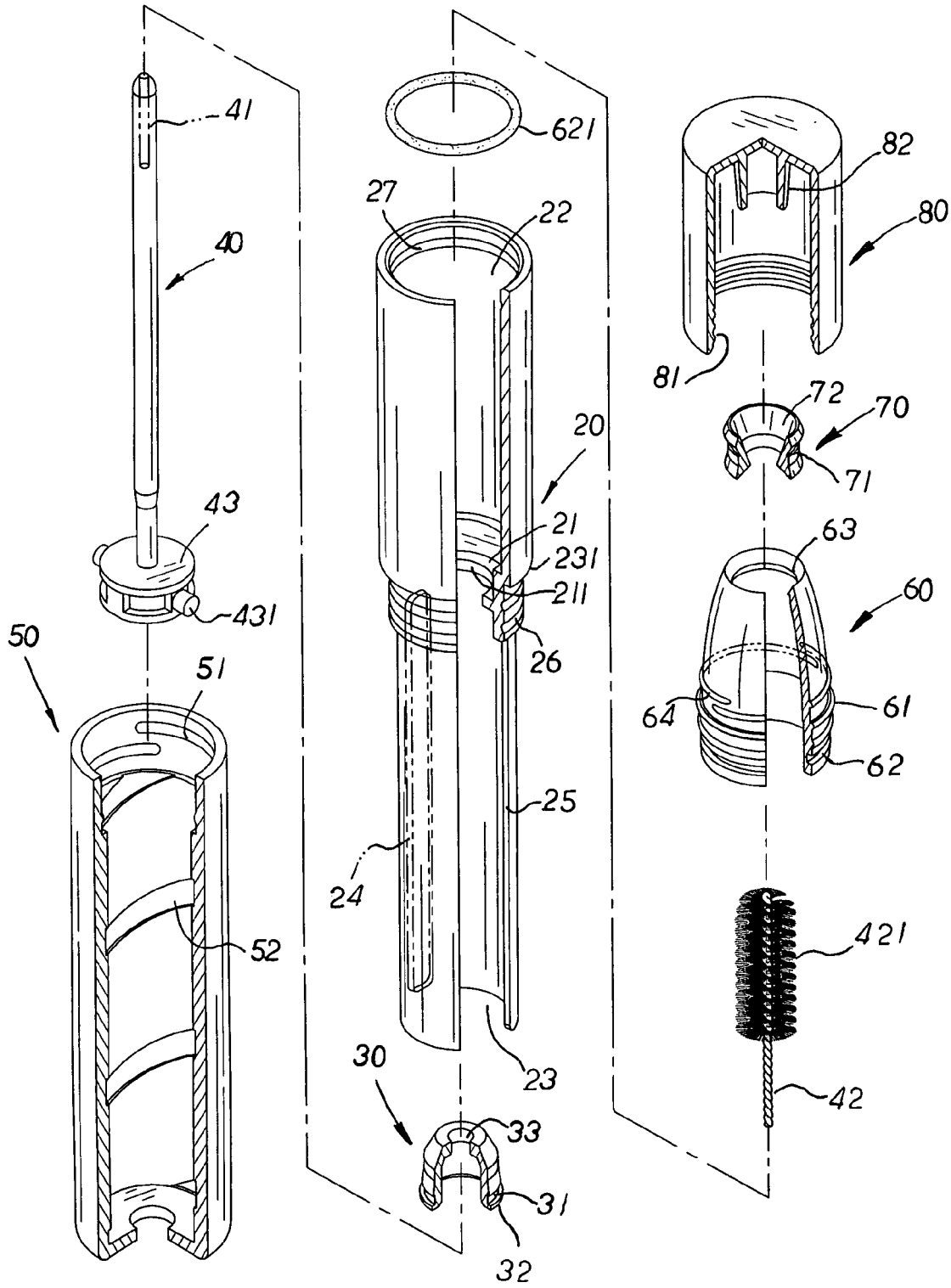
FIG. 2 is a perspective exploded partially sectional view of the cosmetic structure of the present invention.
Figure 3:
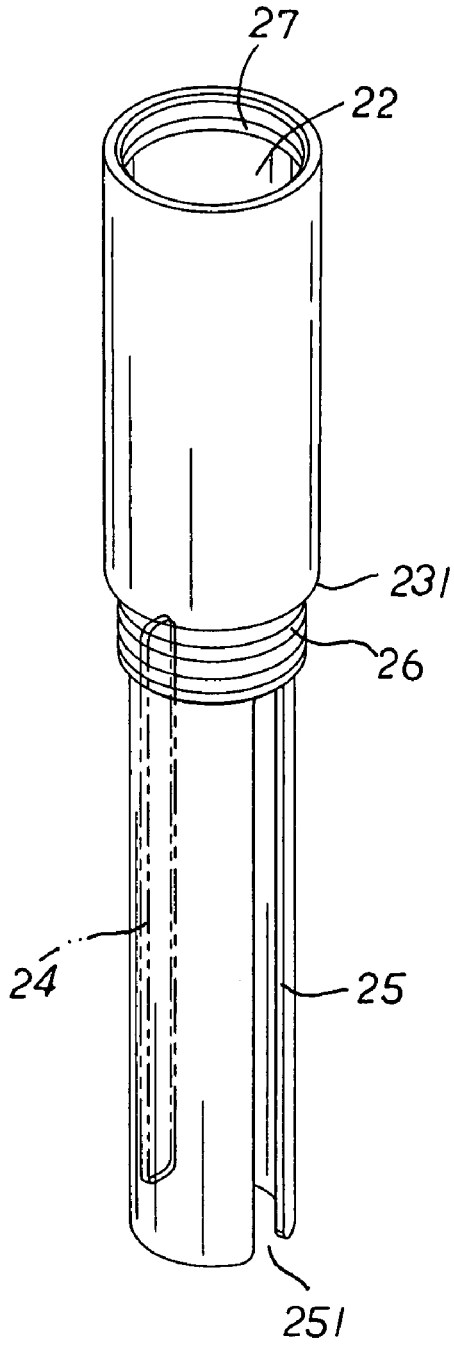
FIG. 3 is a perspective view of the sleeve of the cosmetic structure of the present invention.
Figure 4:
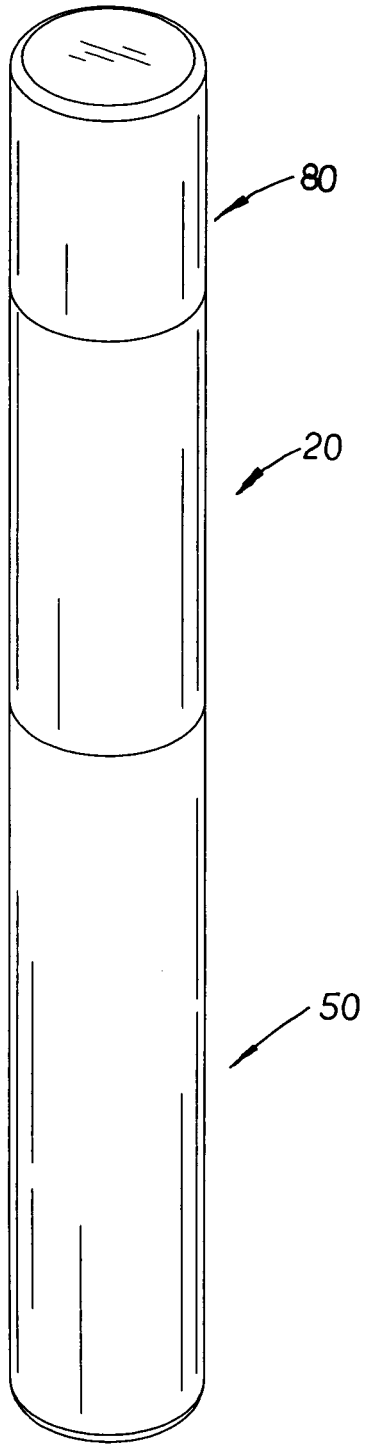
FIG. 4 is a perspective assembled view of the cosmetic structure of the present invention.
Figure 5:
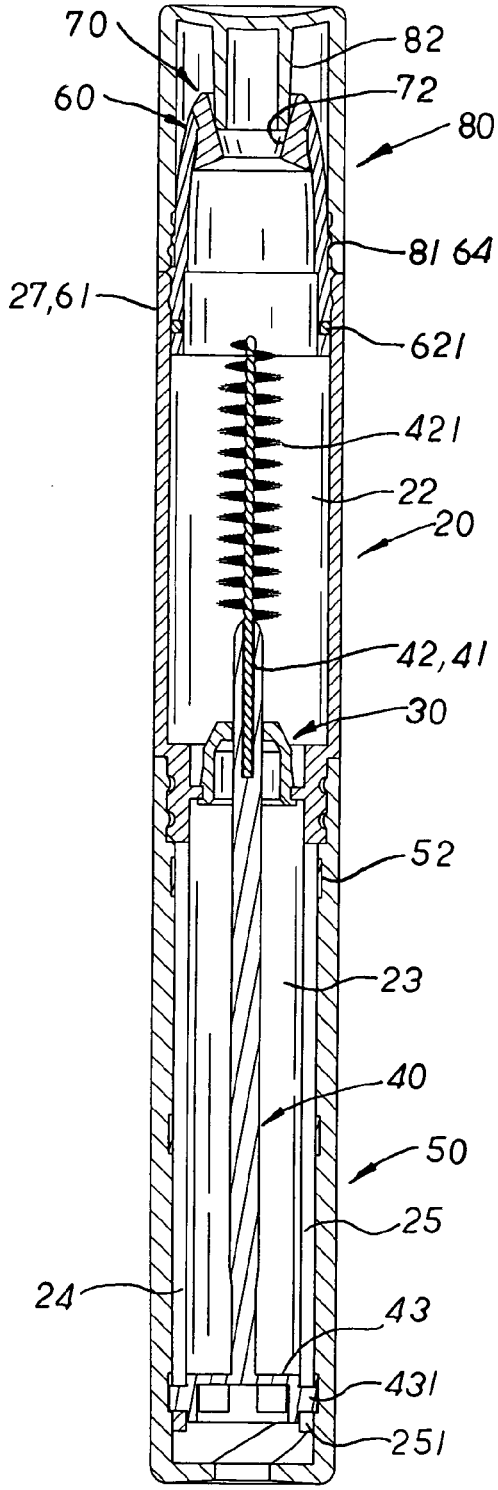
FIG. 5 is a perspective assembled axially sectional view of the cosmetic structure of the present invention.

Please refer to FIGS. 2 to 5. The cosmetic structure of the present invention includes a sleeve 20. An inner circumference of a middle section of the sleeve 20 is formed with an annular stopper section 21 defining a fitting hole 211. A cock 30 made of elastic plastic material is fitted in the fitting hole 211 to divide the interior of the sleeve 20 into a receiving space 22 and an operation space 23. The receiving space 22 has an outer diameter larger than an outer diameter of the operation space 23 to form a step section 231. A lower section of the sleeve 20 is formed with two opposite guide slots 24, 25 communicating with the operation space 23. A lower end of the second guide slot 25 is cut with a split 251. An outer circumference of the middle section of the sleeve 20 is formed with engaging grooves 26. The cock 30 is formed with an annular groove 31 near a bottom end of the cock 30, in which the stopper section 21 is tightly inlaid. In addition, the bottom end of the cock 30 is formed with a flange 32 tightly attaching to a lower face of the stopper section 21. A top end of the cock 30 is formed with a resilient binding through hole 33. An operation rod 40 is upward rotatably fitted through the binding through hole 33 of the cock 30 from the operation space 23. A top end of the operation rod 40 is formed with an insertion socket 41 in which a brush stem 42 with soft brush hairs 421 can be inserted. The brush can be lip brush, eyebrow brush, eyelash brush, etc. The top end of the operation rod 40 protrudes from the cock 30 into the receiving space 22. The wall of the binding through hole 33 resiliently binds and tightly attaches to the operation rod 40 to form a close space for containing cosmetics such as lip cream, eyebrow cream, eyelash grower, etc. A bottom end of the operation rod 40 has a guide seat 43 snugly attaching to inner face of the wall of the operation space 23. Two opposite guide blocks 431 are disposed on the circumference of the guide seat 43. The guide blocks 431 extend through the guide slots 24, 25 and slightly outward protrude therefrom. The present invention further includes a controlling collar 50 having an opening. The opening of the controlling collar 50 is formed with engaging ribs 51 for rotatably engaging with the engaging grooves 26 of the sleeve 20 to locate the controlling collar 50 on the step section 231. The inner diameter of the controlling collar 50 is larger than the outer diameter of the operation space 23. The inner circumference of the controlling collar 50 is formed with a spiral groove 52 in which the guide blocks 431 of the guide seat 43 are inlaid. The inner circumference of the open end of the receiving space 22 is formed with an engaging groove 27. A hollow plug 60 having an engaging rib 61 is fitted in the open end. A lower section of the plug 60 is formed with an annular groove 62 in which a leakproof ring 621 is inlaid. The leakproof ring 621 tightly abuts against the inner circumference of the sleeve 20. The opening 63 of the top end of the plug 60 is tapered. A bush 70 made of resilient plastic material is tightly fitted in the tapered opening 63. The bush 70 is formed with an annular angular insertion groove 71. In addition, the inner circumference of upper section of the bush 70 is formed with an annular tapered thrust face 72. The plug 60 is further formed with insertion ribs 64 above the engaging ribs 61. The present invention further includes a cap body 80 formed with insertion grooves 81 in which the insertion ribs 64 are inlaid. Accordingly, the cap body 80 can be located on the plug 60. In addition, a tubular column 82 projects from inner face of top wall of the cap body 80 to press the thrust face 72 of the bush 70. Accordingly, the liquid cosmetic is prevented from leaking out from the receiving space 22 through the bush 70.

Figure 6:
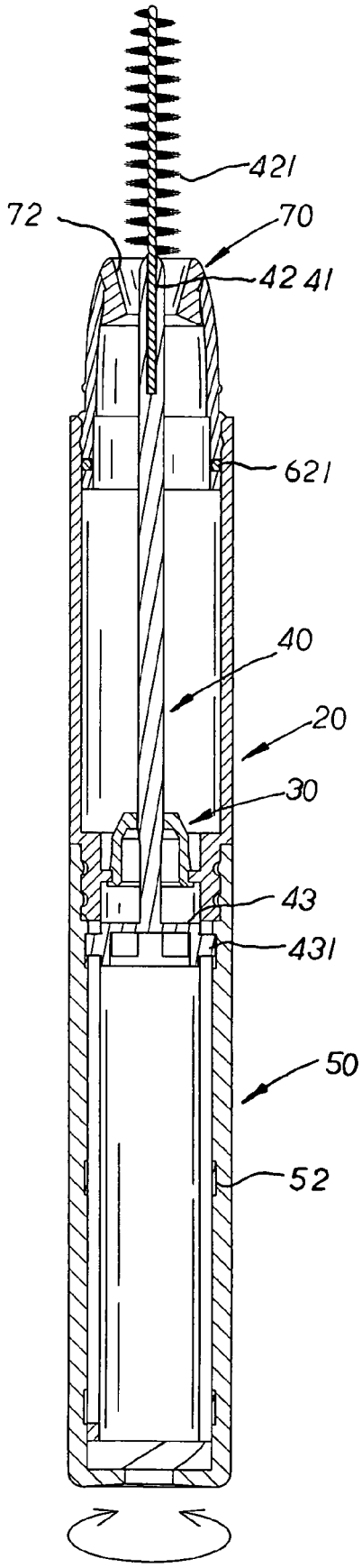
FIG. 6 is a sectional view according to FIG. 5, showing that the brush is extended outward.

In use, as shown in FIG. 6, the cap body 80 is drawn away. Then the controlling collar 50 is turned in one direction, whereby the engaging rib 51 is moved along the engaging groove 26 of the sleeve 20. At the same time, the guide blocks 431 of the operation rod 40 are restricted within the guide slots 24, 25, whereby the guide blocks 431 and the guide seat 43 are guided and pushed by the spiral groove 52 to linearly ascend along the guide slots 24, 25 of the operation space 23 until the brush hairs 421 extend out of the bush 70. At this time, a user can hold the controlling collar 50 with one hand to directly do the makeup. When the controlling collar 50 is turned in a reverse direction, the operation rod 40 is descended along the spiral groove 52 into the receiving space 22. The cap body 80 is then engaged with the plug 60 and mated with the sleeve 20. Accordingly, the present invention can be conveniently used.

The above embodiments are only used to illustrate the present invention, not intended to limit the scope thereof. Many modifications of the above embodiments can be made without departing from the spirit of the present invention.

What is claimed is:

1. A cosmetic structure comprising a sleeve, an inner circumference of a middle section of the sleeve being formed with an annular stopper section defining a fitting hole, a cock having a resilient binding hole being fitted in the fitting hole to divide an interior of the sleeve into a receiving space and an operation space, whereby a liquid cosmetic can be contained in the receiving space, a lower section of the sleeve being formed with two opposite guide slots communicating with the operation space, an operation rod being fitted through the binding hole of the cock from the operation space to the receiving space, a brush stem with soft brush hairs being inserted in a top end of the operation rod, the top end of the operation rod protruding from the cock into the receiving space, a wall of the binding hole tightly resiliently abutting against the operation rod to isolate the receiving space from the operation space, the receiving space having an opening in which a hollow plug with a leakproof ring is fitted, a cap body being engageable with the plug, a bottom end of operation rod having a guide seat attaching to an inner face of the wall of the operation space, two opposite guide blocks being disposed on a circumference of the guide seat, the guide blocks extending through the guide slots and slightly outward protruding therefrom, the cosmetic structure further comprising a controlling collar rotatably fitted around the operation space, an inner circumference of the controlling collar being formed with a spiral groove in which the guide blocks of the guide seat are inlaid, whereby by means of turning the controlling collar clockwise or counterclockwise, the operation rod can ascend or descend to extend the brush hairs out of the sleeve for doing makeup or retract the brush hairs into the sleeve.

2. The cosmetic structure as claimed in claim 1, wherein the cock is made of elastic plastic material.

3. The cosmetic structure as claimed in claim 1, wherein the receiving space has an outer diameter larger than an outer diameter of the operation space to form a step section.

4. The cosmetic structure as claimed in claim 1, wherein an outer circumference of the middle section of the sleeve is formed with engaging grooves and the controlling collar has an opening formed with engaging ribs, the engaging ribs being rotatably engaged with the engaging grooves of the sleeve.

5. The cosmetic structure as claimed in claim 1, wherein an inner circumference of the opening of the receiving space is formed with an engaging groove and the hollow plug is formed with an engaging rib for engaging with the engaging groove.

6. The cosmetic structure as claimed in claim 1, wherein an opening of the top end of the plug is tapered, a bush made of resilient plastic material being tightly fitted in the tapered opening, the bush being formed with an annular angular insertion groove, an inner circumference of upper section of the bush being formed with an annular tapered thrust face, a tubular column projecting from an inner face of a top wall of the cap body to press the thrust face of the bush.

7. The cosmetic structure as claimed in claim 1, wherein the plug is further formed with insertion ribs and the cap body is formed with insertion grooves in which the insertion ribs are inlaid, whereby the cap body can be located on the plug.

8. The cosmetic structure as claimed in claim 1, wherein the cock is formed with an annular groove near a bottom end of the cock, in which the stopper section is tightly inlaid, the bottom end of the cock being formed with a flange tightly attaching to a lower face of the stopper section.

9. The cosmetic structure as claimed in claim 1, wherein the top end of the operation rod is formed with an insertion socket in which the brush stem with soft brush hairs can be inserted.

10. The cosmetic structure as claimed in claim 1, wherein the brush is a lip brush, eyebrow brush or eyelash brush.

* * * * *